US005730187A

United States Patent [19]

Howitz et al.

[11] Patent Number: 5,730,187

[45] Date of Patent: Mar. 24, 1998

[54] FLUID MICRODIODE

[76] Inventors: Steffen Howitz, Wormser Strasse 58, Dresden, Germany, D-01309; Minh Tan Pham, Wolfshugelstr. 7, Dresden, Germany, D-01324

[21] Appl. No.: 696,990

[22] PCT Filed: Feb. 17, 1995

[86] PCT No.: PCT/DE95/00200

§ 371 Date: Oct. 16, 1995

§ 102(e) Date: Oct. 16, 1996

[87] PCT Pub. No.: WO95/22696

PCT Pub. Date: Aug. 24, 1995

[30] Foreign Application Priority Data

Feb. 17, 1994 [DE] Germany ..... 44 05 005.4

[51] Int. Cl.[6] ..... F15C 1/00

[52] U.S. Cl. ..... 137/803; 137/833; 137/896; 417/151

[58] Field of Search ..... 137/803, 833, 137/896; 417/151

[56] References Cited

U.S. PATENT DOCUMENTS

| | | | |
|---|---|---|---|
| 3,777,344 | 12/1973 | Glass | 137/833 |
| 3,865,136 | 2/1975 | Vershur | 137/896 |
| 4,027,407 | 6/1977 | Kiss | 417/151 |
| 4,761,077 | 8/1988 | Werner | 137/896 |
| 5,094,594 | 3/1992 | Brennan | 417/415 |
| 5,165,440 | 11/1992 | Johnston | 137/896 |

OTHER PUBLICATIONS

Heuberger, "Silicon Microsystems", vol. 21, No. 1/4, Apr. 1993, Amsterdam NL, pp. 445–458, XP000361123.

J. Ruzicka et al., "Recent Developments in Flow Injection Analysis: Gradient Techniques and Hydrodynamic Injection", Apr. 1982, pp. 1–15.

Van der Schoot, "A silicon integrated miniature chemical analysis system", Sensors and Actuators, vol. 6, 1992.

Luque de Castro, "Simultanious determination in flow injection analysis", pp. 413–419, 1984, The Analyst, London.

Alexander, "Rapid flow analysis with inductively coupled plasma atomic–emission spectroscopy using a micro–injection technique", vol. 107, No. 1276, Jul. 1982, pp. 1335–1342, London, The Analyst.

*Primary Examiner*—A. Michael Chambers

*Attorney, Agent, or Firm*—Jacobson, Price, Holman & Stern, PLLC

[57] ABSTRACT

The present invention pertains to a fluid microdiode for directionally incorporating a dosed fluid into another stationary or flowing target fluid contained in a closed system, especially in the submicroliter range. It is characterized by a planar arrangement of a microcapillary open on both sides or a system of closely juxtaposed microcapillaries open on both sides being in direct contact with the target fluid on the outlet side thereof and being separated from the discontinuously supplied dosed fluid on their inlet side by an air or gas cushion, forming a meniscus (6) which is curved according to the surface tension. As a device (1), said fluid microdiode consists of a stacked arrangement of a flow channel (9), the actual diode in the form of a grid structure formed by capillaries, and a spacer chip (2), securing the gaseous medium in the region of the coupling surface. These three stacked elements are prepared as modules using technologies of microstructural engineering and may be integrated in microsystems by means of microsystem engineering constructing and connecting techniques. The fluid microdiode is characterized by a simple construction and coupling flexibility to various microflow systems in which exists a hydrostatic pressure in the range of the prevailing ambient pressure.

18 Claims, 1 Drawing Sheet

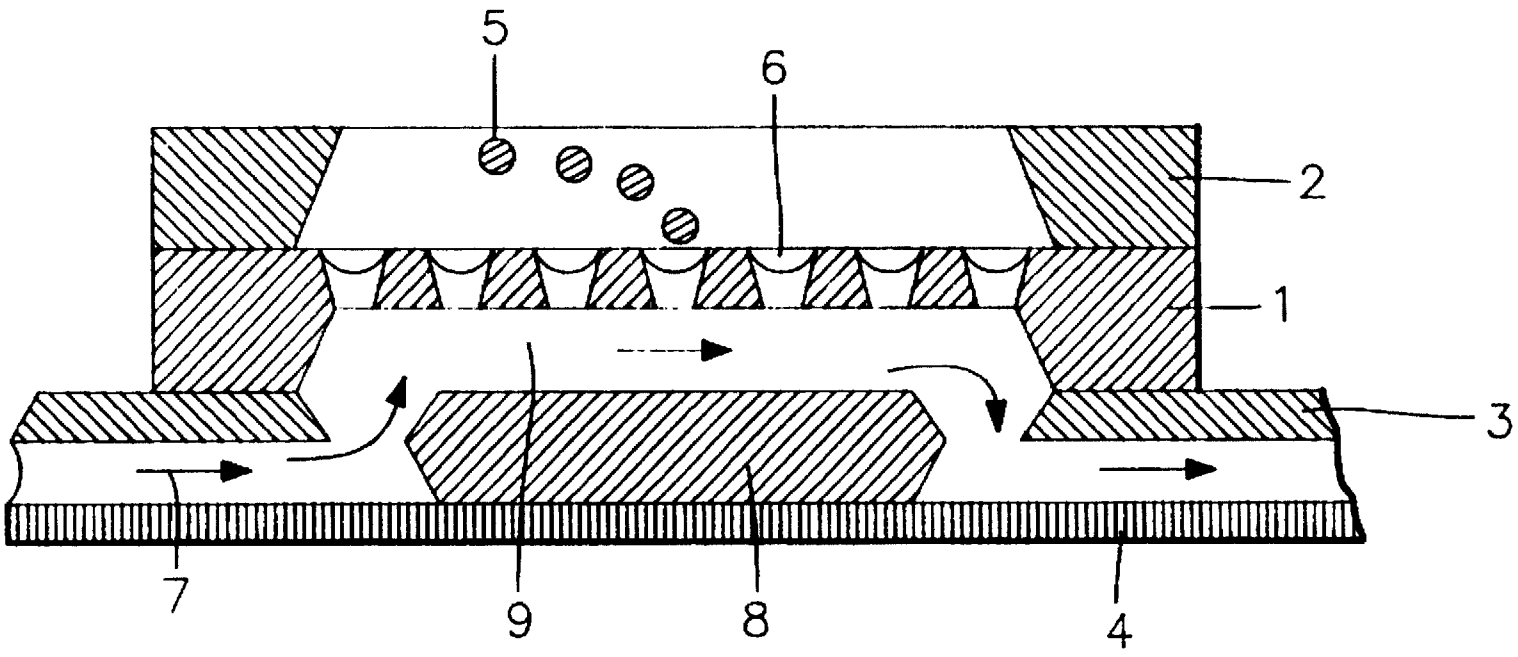
5
6
2
1
3
7
9
8
4

FLUID MICRODIODE

The present invention pertains to a fluid microdiode permeable to fluids in only one direction for directionally incorporating submicroliter quantities of a fluid medium into another stationary or flowing target fluid contained in a closed system. Corresponding requirements exist in the dosing, mixing and injecting of fluids in the submicroliter range for applications especially in the fields of biomedical engineering and chemical microsensor technology.

The incorporation of a liquid into another liquid contained in a closed system is a wide-spread procedure in the fields of medical engineering and flow-injection analysis. As is generally known, such incorporation is effected by injection through a rubber septum [P. W. Alexander et al., Analyst 107 (1982) 1335] or by using rotational injection valves [M. D. Luque de Castro et al., Analyst 109 (1984) 413] or based on hydrodynamic injection [J. Ruzicka et al., Anal. Chim. Acta, 145 (1983) 1]. The currently commercially available devices using these techniques are exclusively based on expensive fine-mechanical manufacturing technologies. There are further known development projects dealing with piezo-electrically driven micromechanical valves based on Silicon technology, especially for use in chemical microanalyzers [van der Schoot et al., A Silicon Integrated Miniature Chemical Analysis System, Sensors and Actuators B6 (1992) 57–60]. The problems arising here are not yet fully understood, the development being still in its infancy. The following problems can be seen presently. Mechanical valves are not capable of completely shutting, which puts restrictions on the accuracy of dosing. A second problem is the large space requirements of such micromechanical members. A third problem is the complicated manufacturing technology since valve structures are complex.

It is the object of the invention, while avoiding the problems encountered with micromechanical valves, to provide a technical solution to the problem of incorporating a dosed fluid into a stationary or flowing target fluid with a high dosing accuracy in the submicroliter range, offering a maximum reliability in preventing the target fluid from flowing into the dosed fluid.

This object is achieved according to the invention by a fluid microdiode which is permeable to fluids in one direction only consisting of one or a system of several microcapillaries open on both sides which are in direct contact with the target fluid on the outlet side and whose inlet side facing towards the dosed fluid is separated from the dosed fluid by an air or gas cushion in such a way that the target fluid spreading upwards in the capillaries is prevented from getting further due to the surface tension and forms a meniscus. The dosed fluid is brought onto this meniscus discontinuously, preferably as a self-supporting fluid jet, and incorporated into the target fluid by diffusion and convection processes.

The fluid microdiode according to the invention is preferably intergrated into a microtechnical flow channel, reliably preventing an outflow of the liquid standing or flowing in the flow channel (target fluid) while ensuring the entry of a second liquid which is to be brought onto said fluid microdiode from the outside (dosed fluid). In the arrangement of a grid-like structure of microcapillaries adjacent to a flow channel, according to the invention, a coupling surface for the incorporation of microdroplets of a dosed fluid is formed by the large number of outwardly oriented open capillaries. The gas/liquid interface at the end of each microcapillary for maintaining the function of the fluid microdiode at any moment is a sine qua non for the functions of the building elements and thus is a part of the building element.

The microcapillaries have dimensions in the μm three-dimensional range and, due to the high accuracy requirements on their geometries, are preferably manufactured by anisotropic etching of <100> or <110> silicon substrates. The length of each individual microcapillary is to be selected such that the target fluid will spread up to the capillary ends and there will form a defined liquid/gas interface in the form of a meniscus at the end of each microcapillary under the action of the surface tension and the fluidic gravitational pressures. The formation of the menisci terminates the process of liquid spreading in each microcapillary, and thus the coupling surface is brought into a reproducible condition. This condition represents the prevailing equilibrium between the static gravitational pressures and, in case of the target fluid's moving in the flow channel, the hydrodynamic pressures. As long as the equilibrium conditions of the pressures are met, the desired directionality exists in all menisci of the entire coupling surface. This means that the target fluid moving or standing in the flow channel cannot leave the microcapillaries in the direction of the droplet chamber, yet a dosed fluid jetted through the gas space of the droplet chamber onto any of the menisci can reach the interior of the microcapillary and thus of the flow channel. The unhindered entry of the second liquid through the meniscus of the first liquid into the flow channel is effected by diffusion and/or convection mechanisms. If the flow rate in the flow channel is exactly zero or the microcapillaries of the fluid microdiode are selected to be of sufficient length, only the diffusion component will account for the mixing of the dosed and target fluids. Any flow rates in the channel which are not zero will directly lead to the formation of convectional components in the microcapillary which are also superimposed by diffusion components. The inflow rate of the dosed fluid through the microcapillaries of the coupling surface into the flow channel can be adjusted by selecting the geometric dimensions of the capillaries.

A particular advantage of such an arrangement is that fluid inflow or mixing sites may be realized which can dispense with the use of conventional valve-pump arrangements, which have been prepared to date with mechanically contacting lip seals and from plastic or elastic sealants. Such arrangements are complicated in macrotechnical constructions and may be used in microtechnical devices only at the price of essential disadvantages. Thus, the arrangements known from the literature which are based on the macrotechnical construction principles are afflicted with some amount of leaking in general. However, for the use in microsystems of environmental and biomedical engineering, the occurrence of leaking is no longer tolerable because of the necessity to apply highly concentrated active compounds in the picoliter to nanoliter range.

The preparation of defined gas/liquid interfaces in the region of the droplet chamber which are relatively insensible towards changes in gravitational pressure in the flow channel, here used in the form of a meniscus in the fluid microdiode, yields a construction form which is both simple and effective and which is also useful for the construction of arrangements comparable with conventional valve-pump arrangements with respect to their effectiveness while exhibiting virtually no leaking.

In the following, the invention will be explained in more detail with reference to the embodiment illustrated in the drawing.

The figure shows a sectional view of the planar construction of a complete FMD device containing the actual fluid microdiode (FMD in the following) according to the invention. The FMD is a chip-like device 1 integrally prepared from <100> or <110> silicon. It is etched into a grid structure 6 on one side and into a continuous flow channel 9 on the other side. The FMD chip 1 is mounted into the glass/silicon flow cell 3 together with the spacer chip 2 which is also made of silicon in such a way that a target fluid 7 can move past the FMD in an unhindered manner, forming small micromenisci in the grid structure 6. The grid structure forms the coupling surface of the fluid microdiode in the direction of spacer chip 2. The preparation of FMD chip 1 is effected by anisotropic etching in KOH solution of both sides. This generates a flow channel 9 in the FMD chip 1 having the geometry l:w:h=1000 μm:500 μμm:250 μm as well as the microcapillaries having the geometry l:w:h=50 μm:50 μm:150 μm. The geometry of the flow channel in the glass/silicon flow cell 3, 4 which is prepared by anodic bonding is w:h=500 μm:250 μm. The entire FMD device comprises the stacked arrangement of, connected by wafer-bonding or adhesive bonding, a fluid flow cell 3, 4 with flow channel 7, 9 and channel stop 8, FMD chip 1 with its microcapillary array 6, and spacer chip 2 forming the adjacent gas or air cushion above the microcapillary array. Spacer chip 2 forming the droplet chamber is also prepared by anisotropic etching in <100> silicon.

Now, when flow channel 7 is flowed through by the target fluid, the latter will wet the microcapillaries and spread up to their opposite opening where it forms a target fluid meniscus 6 independent of the flow rate and dependent on its surface tension and the system-immanent gravitational pressures, the total area of the capillary opening forming a coupling surface for a dosed fluid. When the dosed fluid 5 is jetted onto this coupling surface 6 by means of a microtechnicalpump, it can pass the FMD arrangement 1 and directly reach the flow channel of the target fluid.

With the fluid microdiode according to the invention, a novel element for fluid microhandling is provided having no mechanical valves. The construction of the fluid microdiode according to the invention is substantially simpler than that of the micromechanical valves, resulting in a less expensive manufacture in addition to the smaller space required. In particular, a novel concept for the incorporation of self-supporting fluid jets into a flowing target fluid contained in a closed system can be realized by means of the fluid microdiode.

We claim:

1. A fluid microdiode apparatus comprising:

a) a fluid microdiode element, having opposing sides, including juxtaposed microcapillaries having inlets on one of said opposing sides and outlets openings on said opposing sides of said element, b) means, cooperating with the one of said opposing sides, for introducing a dosed fluid into said microcapillaries, c) means, cooperating with the other of said opposing sides, for introducing a target fluid into said microcapillaries.

2. The apparatus of claim 1, wherein said means for introducing a target fluid into said microcapillaries comprises a flow channel formed in the other of said opposing sides of said fluid microdiode element, adjacent the outlets of said microcapillaries.

3. The apparatus of claim 2, wherein said means for introducing a dosed fluid comprises a spacer chip, which cooperates with the one of said opposing sides to form a chamber adjacent the inlets of said microcapillaries in the one of said opposing sides, said chamber containing a gas.

4. The apparatus of claim 2, further comprising means, cooperating with said means for introducing a target fluid, for moving the target fluid, unhindered, past said fluid microdiode element.

5. The apparatus of claim 4, wherein said means for introducing a target fluid comprises a flow channel in said fluid microdiode device.

6. The apparatus of claim 5, wherein said means for moving the target fluid comprises a fluid flow cell bonded to said fluid microdiode device and a channel stop bonded to said fluid flow cell and disposed adjacent said flow channel.

7. The apparatus of claim 1, wherein said microcapillaries have dimensions that increase in the direction of said inlets.

8. The apparatus of claim 1, wherein said microcapillaries have geometric dimensions that are constant in the direction of said inlets.

9. The apparatus of claim 1, wherein said fluid microdiode element and said means for introducing a target fluid form, as a unitary structure, a silicon-containing fluid microdiode device.

10. The apparatus of claim 9, wherein said means for introducing a target fluid comprises a flow channel in said fluid microdiode device.

11. The apparatus of claim 10, wherein the fluid microdiode device is comprised of silicon having <100> or <110> orientation.

12. The apparatus of claim 9, further comprising means, cooperating with said means for introducing a target fluid, for moving the target fluid, unhindered, past said fluid microdiode element.

13. The apparatus of claim 12, wherein said fluid microdiode element and said means for introducing a target fluid form, as a unitary structure, a silicon-containing fluid microdiode device.

14. The apparatus of claim 13, wherein the fluid microdiode device is comprised of silicon having <100> or <110> orientation.

15. The apparatus of claim 13, wherein said means for introducing a target fluid comprises a flow channel in said fluid microdiode device.

16. The apparatus of claim 15, wherein said means for moving the target fluid comprises a fluid flow cell bonded to said fluid microdiode device and a channel stop bonded to said fluid flow cell and disposed adjacent said flow channel.

17. The apparatus of claim 1, comprised of silicon, glass, metal, or a combination, thereof.

18. The apparatus of claim 1, wherein the micropillaries have dimensions in the μm three dimensional range.

* * * * *

UNITED STATES PATENT AND TRADEMARK OFFICE

CERTIFICATE OF CORRECTION

PATENT NO. : 5,730,187

DATED : March 24, 1998

INVENTOR(S) : Steffen HOWITZ, and Minh Tan PHAM

It is certified that error appears in the above-indentified patent and that said Letters Patent is hereby corrected as shown below:

In column 3, line 13, change "μμm" to --μm--.

In claim 1, line 4, change "outlets" to --outlet--.

In claim 18, line 2, change "micropillaries" to --microcapillaries--.

Signed and Sealed this

Twenty-eighth Day of July, 1998

Bruce Lehman

*Attest:*

BRUCE LEHMAN

*Attesting Officer*

*Commissioner of Patents and Trademarks*